US005829917A

United States Patent [19]

Maudal

[11] Patent Number: 5,829,917

[45] **Date of Patent: *Nov. 3, 1998**

[54] TIDAL SYSTEM AND METHOD FOR CLEANSING A HARBOR

[76] Inventor: Inge Maudal, 604 Lassen La., Costa Mesa, Calif. 92626-3122

[ * ] Notice: The portion of the term of this patent subsequent to Aug. 9, 2011, has been disclaimed.

[21] Appl. No.: 238,926

[22] Filed: May 6, 1994

Related U.S. Application Data

[63] Continuation of Ser. No. 880,901, May 8, 1992, Pat. No. 5,336,018, which is a continuation of Ser. No. 497,489, Mar. 22, 1990, abandoned.

[51] Int. Cl.[6] ..... E02B 3/00; E02B 5/00

[52] U.S. Cl. ..... 405/52

[58] Field of Search ..... 405/36, 37, 51, 405/52, 60, 74, 81, 83, 84, 99, 100, 127; 137/236.1, 843, 527.6

[56] References Cited

U.S. PATENT DOCUMENTS

| | | | |
|---|---|---|---|
| Re. 27,353 | 5/1972 | Shettel . | |
| 420,367 | 1/1890 | Walker | 137/527.6 |
| 833,544 | 10/1906 | Parker | 405/80 |
| 921,513 | 5/1909 | Crawford . | |
| 1,094,310 | 4/1914 | Deal | 405/74 |
| 1,334,354 | 3/1920 | Dodd . | |
| 1,591,421 | 7/1926 | Gilbert | 405/127 |
| 2,093,515 | 9/1937 | Filkins | 137/527.6 X |
| 2,176,522 | 10/1939 | Brown | 137/527.6 |
| 2,259,128 | 10/1941 | Egan | 137/527.6 X |
| 2,361,231 | 10/1944 | Nebolsine | 405/127 X |
| 3,492,822 | 2/1970 | Josephs . | |
| 3,543,521 | 12/1970 | Aubert . | |
| 3,667,234 | 6/1972 | De Lizasoain . | |
| 3,733,830 | 5/1973 | Jacobs . | |
| 3,889,710 | 6/1975 | Brost | 137/843 X |
| 3,952,522 | 4/1976 | Shettel | 405/37 |
| 3,974,654 | 8/1976 | Mirto | 405/127 |
| 4,162,864 | 7/1979 | Maeda et al. | 405/75 |
| 4,298,471 | 11/1981 | Dunkers | 405/52 X |
| 4,324,506 | 4/1982 | Steinke | 405/127 X |
| 4,606,672 | 8/1986 | Le Sire | 405/99 X |

FOREIGN PATENT DOCUMENTS

| | | | |
|---|---|---|---|
| 148908 | 8/1985 | Japan . | |
| 51505 | 3/1988 | Japan . | |
| 51506 | 3/1988 | Japan . | |
| 653331 | 3/1979 | U.S.S.R. . | |
| 421446 | 12/1934 | United Kingdom | 137/527.6 |

*Primary Examiner*—John A. Ricci

[57] ABSTRACT

A system and method for cleansing a polluted harbor by achieving general circulation of water between an open sea and the polluted harbor are disclosed. The system and method utilize the natural wave-like behavior of the water when ocean tides propagate from a harbor entrance in the open sea to a back harbor and back out to sea again. Surface elevation variations along the propagating wave provide hydrostatic pressure differentials between areas along the path of propagation. When connecting two such areas with a conduit, the pressure differential between two areas causes water to flow in the conduit. The system includes a conduit which connects an area of the open sea with a back harbor area. The conduit may be installed along a channel of the harbor so that it extends through the harbor to the back bay, or it may be positioned to cut across or through a strip of land separating the back harbor from the open sea. One end of the conduit has a check valve, thus forcing water flow through the conduit in only one direction, establishing a positive circulation of clean sea water flushing the polluted harbor. The check valve may be automatically responsive to directional water flow in the conduit, differential tidal water pressures between the open sea area and the inner arbor area, or it may be actuated by a suitable external control systems and power sources.

15 Claims, 5 Drawing Sheets

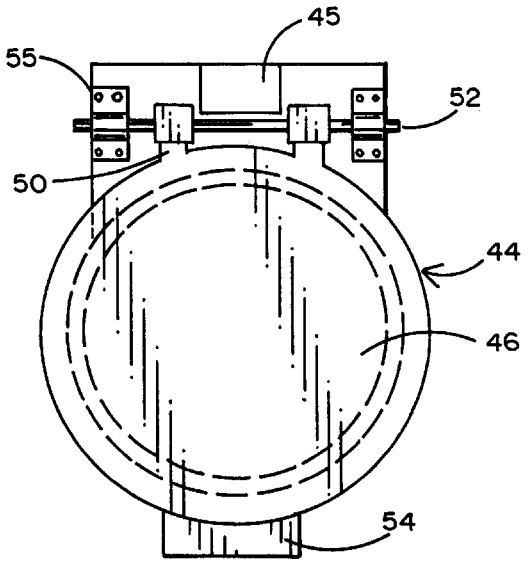
FIG. 7a
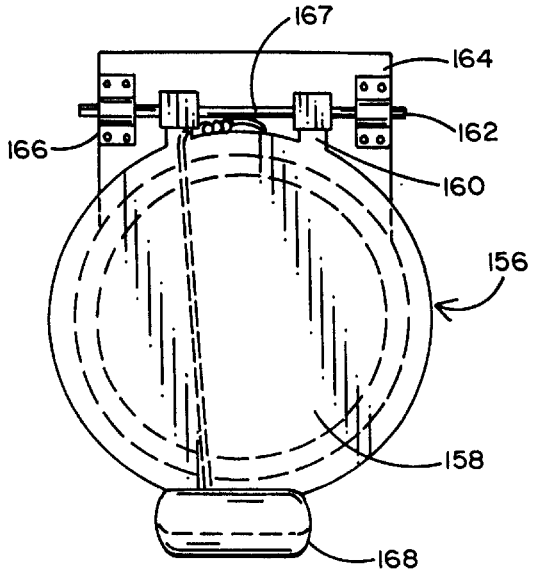
FIG. 8a
FIG. 9a
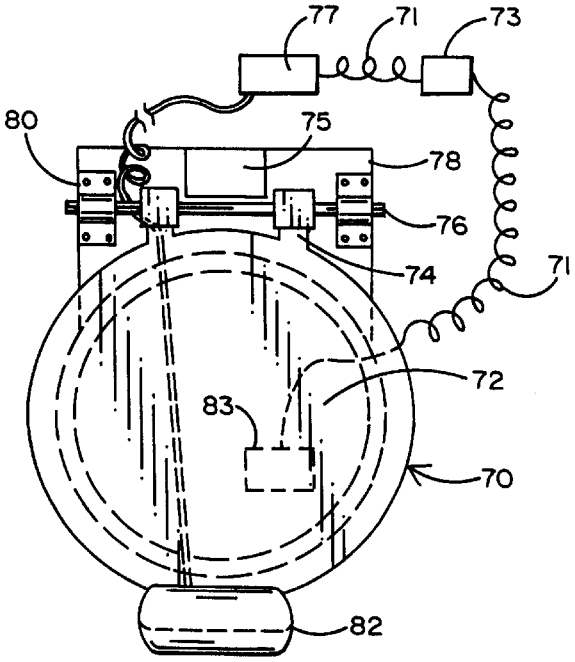

TIDAL SYSTEM AND METHOD FOR CLEANSING A HARBOR

This application is a continuation of application Ser. No. 07/880,901, filed May 8, 1992, now U.S. Pat. No. 5,336,018, which is a continuation of application Ser. No. 07/497,489, filed Mar. 22, 1990, now abandoned.

BACKGROUND OF THE INVENTION

This invention relates generally to systems and methods for cleansing harbors and estuaries that suffer from inadequate natural flushing means. In particular, the invention relates to systems and methods which utilize the forces produced by the ocean tides to obtain significant and general circulation of clean ocean water.

A harbor or a bay is a general water way extending from the ocean, through a natural channel, and thence into a back harbor. All harbors and bays receive cleansing benefits from the tide. However, as will become apparent, the natural action of the tide is very inefficient. Rather than obtaining a general circulation, which replenishes water in a back harbor or bay with clean ocean water, the action of the tide merely "sloshes" the water back and forth in the natural channel. Actual cleansing of a back bay must depend on general mixing of water between that which is stationary and that which "sloshes" back and forth.

Before assessing what is efficient and what is not regarding cleansing actions of the tide, consider the general phenomenon that is the tide. The tide is caused by cyclic forces provided primarily by the gravitational pull of the moon on the ocean waters. In response to these gravitational forces the water surface rises in elevation to form a wave; the resulting wave seeks to follow the relative position of the moon with respect to the earth. However, the actual forward velocity of the wave is modified by the free velocity of disturbances in water. It is equal to the square root of the product of the acceleration of gravity and the depth of the water. This free velocity constitute the forward propagation velocity of the tide.

The cyclic gravitation forces and the free velocity of propagation combine to give the tide a natural, wave-like character. Thus the tide propagates in the form of a series of crests and troughs similar to wind-driven waves. The wavelength, the distance from crest to crest, of the tide wave is determined by the free velocity in water and the lunar period according to well understood physical principles.

The wavelength in an open ocean is measured in hundreds of miles; implementation in the open ocean is therefore not practical (even should it be desirable). However, in a relatively shallow harbor, or in a wetlands area or bay, the water depths are such as to establish wavelengths that are measured in miles or fractions of a mile instead of hundreds of miles.

Two factors must be present before this invention is practicable: one, the harbor channel must be long enough, relative to the wavelength of the tide wave within the harbor, to generate a useful head; second, the harbor must be relatively shallow in order to shorten the tide wavelength to practical proportions. This fortuitous combination is true of a significant number of coastal harbors. It is this that makes this invention feasible. There is no need for a narrow entrance to effectively dam the tide. In a relatively shallow harbor the applicant's invention require as structure only a connective conduit system; it does not need any dam means or artificially created constrictions, which impedes shipping, for the purpose of creating a head.

The change in surface elevation along the path of propagation of the tide wave is a fundamental characteristic of tide behavior. However, it is important to note that it is only the wave form that propagate; the elevation changes do not precipitate significant water flow in the direction of propagation of the tide wave. Indeed, the tide in an open ocean manifest negligible amounts of flow; in a shallow harbor the flow is measurable, however, the flow basically constitute a "sloshing" back and forth along the natural channel of the harbor. This "sloshing" action is not sufficient to effectively cleanse a polluted back harbor.

However, the elevation changes in the propagating tide wave do produce corresponding hydrostatic pressure changes in the water along the path of propagation. A difference in hydrostatic pressure between diverse points along the path produces a hydrostatic pressure differential, or head; should a submerged pipe connect a tide crest with a trough, then significant amounts of water will flow according to well understood hydraulic principles of flow of fluids under the influence of a head.

The diverse points may lie anywhere along the path of propagation. For example, one point may be in the ocean and another in an inner harbor, or back bay. The actual head varies cyclically with the tide cycle. For an incoming tide, water elevation at the entrance will be higher than elsewhere; for a outgoing tide, the elevation is higher at the back harbor.

The natural wave characteristic of the tide thus provides the fundamental underlying principle of this invention. The invention relies on the natural principle which creates a head between points along the path of propagation; the invention implements the principle with structures connecting one point along the path of propagation to another. The points chosen are generally that of the open ocean and that of a back harbor or bay. The principle is completely general. Therefore, the invention as described would theoretically function equally well in an open ocean. It needs no artificial obstruction to generate a head; the generated hydraulic head is inherent in the nature of the tide.

Some prior art systems also use naturally occurring circumstances to provide the energy to cleanse a harbor. An example is disclosed in U.S. Pat. No. 833,543 to Parker which uses the energy in wind driven waves to cleanse a Harbor. The Parker device uses the force of impact or dash of waves against a floating apron. The apron floats so that the top of the apron lies in the water surface. The waves, upon impact, splashes over the top of the apron and into a collecting reservoir behind the apron. The level of available energy is therefore limited to a head that is at a wave-determined differential height relative to the apron.

The apron of the Parker patent floats on the surface of the ocean water; it is therefore also floats with the tide. Consequently, only wind driven waves splashes over the apron. Thus, the Parker invention does not utilize the tide as a head producing agent.

Other types of prior art devices for cleansing harbors utilize reservoirs to collet waters moved by tidal flow. An example of such a device is disclosed in U.S. Pat. No. 4,162,864 to Maeda. The Maeda device uses one or more reservoirs to collect and store water brought therein by the tide.

An example of prior art which directly utilizes the tide is described in 63-51506 Hashiguchi et al (Japan), referred to hereinafter as Japan '506. The teaching in Japan '506 shows a small boat harbor protected from storms by a dam or breakwater placed across the mouth the harbor. An opening is cut in the breakwater to provide access to the harbor. Imbedded in the breakwater is an enclosed conduit. The conduit, as shown in FIG. 2 of Japan '506, extends from immediately outside the breakwater (the ocean side) to an area inside the breakwater (the harbor side). The conduit has a hinged valve in one end.

The predominant structure in Japan'506 is clearly the dam or breakwater placed across the mouth of the harbor. In operation Japan '506 literally dams the tide; thus Japan'506 develops a head with the dam or breakwater. The presence of a restrictive opening does not change this. Thus, as the water level increases with the tide, the restrictive opening limits the flow of water from one side of the dam to the other side; this limited flow in the restricted opening preserves the head in Japan'506. This is settled physical principle of dynamic flow in fluids.

In Japan '506 the head occurs between the ocean side and the harbor side of the breakwater. This is verified conclusively in FG. 2 of the disclosure. The figure shows a vertical cross section of the breakwater and the harbor and shows the water levels of the ocean and well as the harbor; the change in levels occurs within the dam and within the narrow opening in the dam. The height of the head is indicated in Japan'506 as occurring immediately adjacent the breakwater. This is further emphasized by showing that the water level of the harbor is flat from the breakwater to the bottom of the harbor; there is no indication of surface elevation changes characteristics of a propagating tide wave.

The invention of Japan '506 creates a head by using an existing dam or placing a new dam across a mouth of a harbor. In either case the dam is an essential function of the invention; it is also a massive structural element of the embodiment of the invention and constitutes a severe impediment to general shipping.

A harbor cleansing system is thus needed which can effectively flush water from stagnant (or dead water) areas of a harbor. A harbor cleansing system is needed that is also economical and neither requires extra harbor space nor interferes with general shipping.

SUMMARY OF THE INVENTION

It is a principal object of the present invention to provide a system and method for cleansing a harbor.

It is another object of the present invention to provide a system and method for obtaining general circulation of clean ocean water in to flush stagnant water from a harbor.

It is also another object of the present invention to provide a system and method for cleansing a harbor which utilize tidal water forces.

It is also an object of the present invention to provide a system and method which are capable of flushing water and contaminants from inner areas of a harbor.

It is an object of the present invention to provide a system for cleansing a harbor which is economical to construct and maintain.

It is an object of the present invention to provide a system for cleansing a harbor which requires minimal harbor space.

It is an object of the present invention to provide a system for cleansing a harbor which is automatic in operation.

It is an object of the present invention to provide a system for cleansing a harbor which is simple in construction and operation to provide long life and trouble free performance.

The present invention seeks a simple structure for directing fresh sea water to an inner area of a harbor. The invention realizes full simplicity of embodiment by taking advantage of the head existing between areas along the path of propagation of the tide; a specific head between an open ocean and a back harbor represents a particularly useful fountain of clean ocean water to the back harbor. The invention establishes general circulation between the open ocean and a back harbor, preferably by admitting clean ocean water directly into the back harbor and by forcing contaminated water to flow out of the harbor through the main harbor channel.

The direction of circulation may be reversed if so desired. It may be desirable to exhaust particularly polluted water from one part of an harbor and admit clean water by way of the harbor channel.

Three general elements translate the functional entity that is the tide into structures comprising this invention: an extended conduit, valve means placed in the conduit, and valve timing means.

The extended conduit is emplaced with one end in an area near the open ocean and the other end in or near the back harbor. The function of the conduit is to facilitate flow of water responding to the tide head between the ocean and the back harbor.

The conduit is a general fluid conductor, closed in circumference and open at both ends; examples are water pipes, storm drains, or culverts. The conduit in a general embodiment is submerged; the open ends of the conduit then accurately reflect the head between the ends. The head will act with a force that causes water to flow in the direction of the lower hydrostatic pressure, i.e. towards the trough of the tide wave. Because water is an incompressible liquid, the flow is immediate.

A specific depth of placement of the conduit is not important. The reason for this lies also in the incompressible nature of water; thus the pressure of the added weight of water in an elevated wave will extend to substantial depths. Similarly, the pressure of the absent weight of the displaced water in a wave trough will also manifest at to substantial depths. The difference in pressures, or the head, therefore operates unchanged. This is also true even if the ends of the conduit are placed at dissimilar depths. This is explained by the weight of the water in the conduit, and is a well known feature of the pressure characteristics in fluids.

A specific path of the conduit through the harbor is not necessary either. For example, the conduit need not be placed along the path of propagation of the tide; only the placement of the ends is relevant. This is of utmost importance in certain embodiments of this invention. The inner end, or outlet, should preferably be placed near the path of propagation of the tide through the harbor channel or be placed in the back harbor; this would result in the most benefit from the generated head.

A specific interval between the openings, and thus the effective length of the conduit, depends generally on the harbor at issue. The tide wave length is a major determining characteristic since it depends on the average depth of the particular harbor; this wavelength largely determines the size of a tide head at a given distance. The size of the harbor also determines the needed amount of flush water to cleanse the harbor, and thus bear on the required cross-section of the conduit. Another factor is the available height of the tide, or the swing between high and low tide in the ocean outside the harbor. The hydraulic losses incurred in the conduit is likewise a factor. All these factors taken together determine the design of the system, a task that is the discipline of hydraulic engineers and oceanographers, the men and women of ordinary skill in the art.

The valve means is placed preferably in only one end of the conduit. The function of the valve means is to establish general circulation of water between the ocean and the back harbor.

Without valve means the water flow in the conduit follows the cycle of the main harbor channel. As the cyclic tide change direction of propagation, so does the head along the path of propagation change direction, so also does the flow in the conduit change direction. The water in the conduit therefore sloshes back and forth in the manner of the water in the natural channel of the harbor. There is some minor improvement in cleansing of the harbor with the added flow from the conduit; however, the improvement is nowhere near the expected improvement resulting from a general circulation of clean water.

The valve means provides for general circulation of water by permitting water to flow in only one direction through the conduit. For example, the valve may preferably permit water to enter the back harbor from the ocean during an incoming tide, but prevent water from returning to the ocean through the conduit during an outgoing tide. The process is cyclic with the tide. An incoming tide produces inflow of water through the conduit; an outgoing tide produce no flow in the conduit. Therefore, the inflow water must ultimately return to the ocean via the natural channel of the harbor. This sets up the preferred circulation of clean ocean water through the harbor.

The reverse circulation may be advantageous in some circumstances. In such a case the valve means will permit contaminated water to flow out from the back harbor and clean water enter the harbor via the natural harbor channel.

A number of valves and valve designs would fulfill the requirements of opening or shutting off the flow of water in the conduit. However, check valves exemplify most closely the preferred embodiment of this invention. In a check valve, a gate or disk is free to swing against or away from a seat. When forced against the seat, the disk blocks fluid flow; when the disk swing away from the seat, fluid flows unhindered through the seat. The disk generally swings freely. The direction of the flow of fluid essentially controls the position of the disk. In one direction the fluid flow forces the disk against the seat and the disk blocks further flow; in the other direction the fluid forces the disk away from the seat and the fluid flows freely. Consequently, these valves allow flow of fluids in one direction only.

A preferred embodiment consist of a hinged lid at one end of the conduit. The lid mechanism is mounted on the outside of the conduit; the end of the conduit thus serves as the seat of a typical check valve. The lid is generally hinged at either the top or the bottom and free to swing with differential pressure or flow of water. When pressure on the inside of the lid is greater, the lid swings open; when the pressure on the outside is greater, the lid will remain shut. Similarly, when water flows out of the end of the conduit, the force of the flowing water opens the lid; when water seeks to enter the end of this conduit, eddies and swirls of water around the lid creates drag which shuts the lid and prevents further flow of water. Trim tabs may accentuate this effect. The lid is generally neutrally buoyant.

A variable and controlled buoyancy of the lid is also an element of this invention. The buoyancy of the lid may be varied by including a chamber of air as part of the lid structure. For example, an inflatable balloon attached oppositely the lid hinge would provide rotational moments to close the lid with the inflated balloon; deflating the balloon would create the opposite effect. Control may be provided by an air compressor, for example. Another method is the use of a sealed cavity in the lid; the cavity could be filled with water to provide negative buoyancy, then the water could be forced out with compressed air to obtain negative buoyancy.

A slanted check valve seat is another element of this invention. The end of the conduit is cut off at an angle from vertical. This provides opening of the conduit to full flow rate faster with a smaller angle of rotation of the lid. It also provide a better seal for the variable buoyancy lid since the vertically directed buoyancy will have a component normal to the slanted seat and thus also force the lid against the seal.

The merger of the variable buoyancy lid and the slanted seal form a particularly advantageous combination. The variable buoyancy is used to open and close the lid; the slanted check valve lid combines to increase the operating effectiveness of the variable and controlled buoyancy system. For example, if the lid is hinged at its bottom and the seat is slanted over the lid, then a positive buoyancy of the lid provides a positive seal in closing the valve and maintaining it closed; intentionally reducing the buoyancy in this embodiment lowers the lid and opens the conduit fully with a relatively small angular displacement of the lid. Several variations of lid buoyancy and slant angles of the seat are possible.

Valve Timing Means are an integral part of the overall conduit system. The function of the Valve Timing Means is to keep the valve, and therefore the flow of water, in time with the tide cycle to achieve a one way flow of water.

The valve timing means regulates the function of the overall conduit system. Specifically, the timing means governs the valve to operate in concert with the tide cycle; the valve is opened to allow water to flow when the head is favorable, the valve is closed to prevent flow in a wrong direction.

Several timing means are applicable. For example, a simple timing means could be set to specific times in the tide cycle. The timing means could also be a pressure gauge indicating a favorable head; or it could be a combination of the two.

A preferable timing means is the pressure gauge and check valve embodiment. In this configuration, a head across the conduit will act both as the timer as well as an actuating system. Mounting the external check valve on one end also determines the direction of water flow.

A shortened conduit is an alternate general element applicable to certain harbors. Such is the case when the natural channel of the harbor, after the entrance from the ocean, turns to a direction essentially parallel the coast line. In this case a back harbor is separated from the ocean by only a narrow strip of land. The shortest distance between the open ocean and the back harbor runs across this narrow strip of land; a most efficient approach in this case is to route the conduit across the same narrow strip of land.

Two factors make this a viable embodiment: one, the tide wave length in the ocean is so large that the water surface elevations of the ocean outside the harbor entrance and outside the back harbor are equal; two, the water surface elevation of the back harbor is only dependent on the tide propagation through the natural harbor and not on the proximity of the back harbor to the ocean. The principles of this system are the same as those for the enclosed extended conduit and will not be repeated.

An open trench, or a canal, instead of an enclosed conduit, may replace the enclosed conduit. This embodiment would apply when the narrow strip of land is flat and narrow; a sand bar is an example. In this case the tide must propagate from the entrance of the harbor to the back harbor as before. Similarly, the tide must also propagate along the open trench. However, the open trench is generally very short and does not produce a significant tide head. Valve means and timing means complete the system as before.

Instead of utilizing a check valve or functionally similar structure, the shortened conduit may be completely open at both ends. Such an open ended conduit may be desirable if the particular characteristics of the harbor in which it is utilized would make the conduit effective. For example, if the propagation losses in the harbor are large enough to insure that the water level in the back harbor always be lower that the ocean, such a system would be preferable because of lower construction costs.

It is an important feature of the invention that the end, or outlet, of the conduit may be positioned anywhere in the harbor where the flushing action of the system of the present invention is needed to cleanse stagnant harbor waters. Thus, although it is generally preferable to have the outlet placed in the innermost areas of the harbor where typically the most contaminated stagnant waters are to be found, the outlet may be positioned anywhere in the harbor where it may be deemed most effective in cleansing stagnant water areas of the harbor.

It is also an important feature of this invention that the inlet of the conduit be positioned in a variety of areas near the open ocean. Extending the conduit all the way out into the open ocean may be expensive. The conduit must satisfy general coastal anomalies, such as sand drift, which requires that the inlet be placed far into the ocean. Similarly, the inlet has to be placed in depths beyond the influence of storms and the like. A less expensive alternative is available by placing the inlet end of the conduit substantially just inside the harbor entrance. Here the tide is yet very close to the cycle of the open ocean, the water is still generally clean, and there is still a substantial tide head between the harbor entrance and the back harbor.

It is also an important feature of the invention that the direction of flow may be oriented in an outward direction. Thus, where a bay is particularly polluted by an open sewer, the conduit may empty waste products into the ocean and receive fresh water from the normal flow through the natural channel of the harbor. This is a reverse circulation.

It is further an important feature of the invention that a multiplicity of conduits may be used and that separate conduits may then operate in opposite directions to further the more efficient flushing of the bay.

BRIEF DESCRIPTION OF THE DRAWING

FIG. 7*a* is a front plan view of a first lid mechanism connected to the conduit of the first embodiment preventing reverse flow of water through the conduit.

FIG. 8*a* is a front plan view of a second lid mechanism connected to the conduit of the first embodiment preventing reverse flow of water through the conduit and having variable volume air bags.

FIG. 9*a* is a front plan view of a third lid mechanism connected to the conduit of the first embodiment for preventing reverse flow of water through the conduit and having a compressor connected to a variable volume air bag.

DETAILED DESCRIPTION OF THE PREFERRED EMBODIMENT

Figure 1:
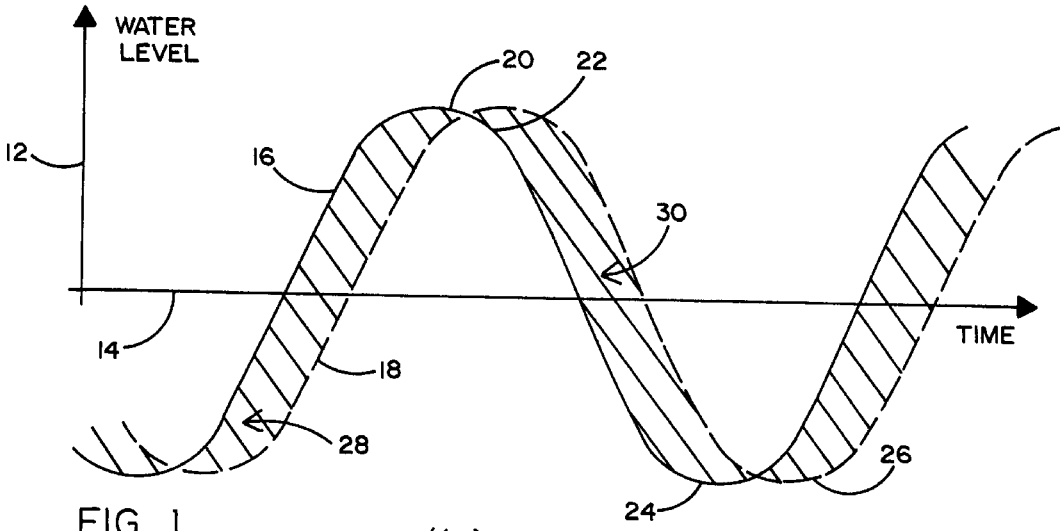
FIG. 1 is a graphical diagram of the water levels of a representative inner harbor area and a representative proximal open sea area illustrating their time phase relationship.

Referring to the drawings, FIG. 1 is a graph showing the time phase relationship of the water levels in a representative inner harbor area and a representative open sea area. The ordinate 12 represents water level, and the abscissa 14 represents time. The curve 16 in the graph of FIG. 1 represents the tidal water levels in the open sea area, and the curve 18 represents the tidal water levels in the inner harbor area. Curves 16 and 18 are generally sine waves. The open sea area reaches high tide water levels at time 20 and low water levels at time 24, while the inner harbor area reaches high tide water levels at a later time 22 and low tide water levels at a later time 26. The area 28 between the curves 16 and 18 shows the time lag between the inner harbor and the open sea areas in moving from low tide to high tide water levels. During this first time lag period of area 28, the open sea water levels are higher than the inner harbor water levels. This time lag between the inner harbor and open sea areas creates a pressure differential that is relied on in the present invention. Conversely, the area 30 between the curves 16 and 18 shows the time lag between the inner harbor and open sea areas in moving from high tide to low tide water levels. During this second time lag period of area 30, the open sea water levels are lower than the inner harbor water levels.

Figure 2:
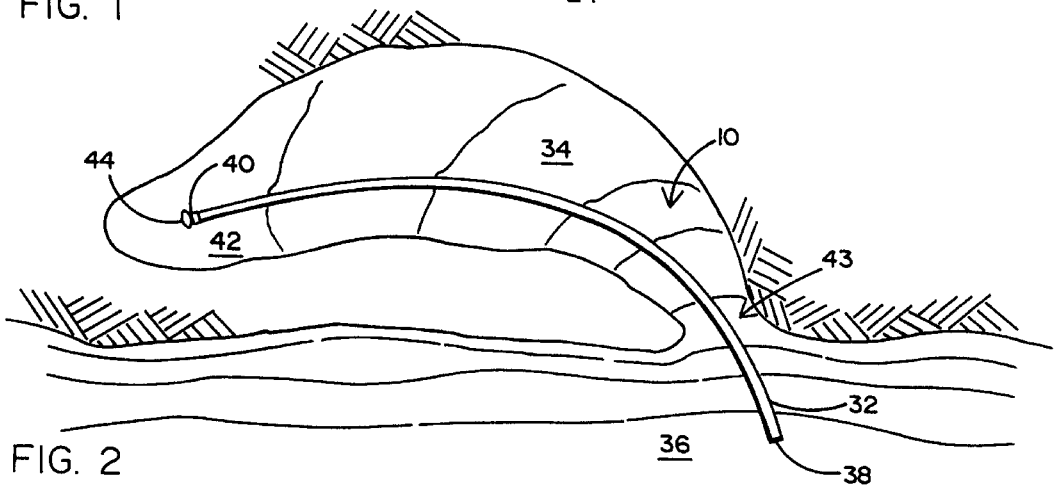
FIG. 2 is a top plan view of a first embodiment of the present invention showing a conduit submerged under the water in the harbor, bay and open sea.

FIG. 2 shows a first embodiment of the invention generally designated by the numeral 10. Embodiment 10 includes a conduit 32 positioned in a harbor 34 and an open sea area 36. Conduit 32 preferably extends through the bay 43 of the harbor 34. Conduit 32 is preferably closed on its upper, lower and lateral sides and is in the form of a generally tubular pipe with a generally circular cross-section although it could also have any other suitable cross-sectional. shape. Conduit 32 also preferably has an inlet 38 located in the open sea area 36 and an outlet 40 located in an inner harbor area 42. Inlet 38 is preferably submerged below the low tide water levels of the open sea area 36. In addition, inlet 38 is preferably submerged at a depth sufficient to allow it to avoid the adverse effects of waves and surface currents caused by storms, weather conditions etc. Conduit 32 is also preferably submerged to a depth which avoids interference with shipping.

Conduit 32 also preferably is provided with valve means and timing means which will open and close the conduit 32 according to the time of the tide pressure differentials as shown in FIG. 1, and thus allow water to flow only into the inner harbor area 40. However, since the pressure differential between the open sea area 36 and the inner harbor area 40 manifest at the end of the conduit 32, then it is preferred to employ a one way valve lid mechanism or other suitable means for preventing water from flowing out of the inner harbor area 42 and into the open sea area 36 via conduit 32 when the water level in the inner harbor area 42 is higher than the water level in the open sea area 36 (during the time period represented by area 30 in FIG. 1). A first lid mechanism 44 provides preferably timing or sensing means synchronized to the tide for opening and closing of the lid 46 (and outlet 40). Outlet 40 is preferably slanted to facilitate water flow out of the outlet 40 by reducing the angle of lid rotation needed to fully open the outlet 40. The structure and function of lid mechanism 44 will be described in detail hereinbelow.

Figure 3:
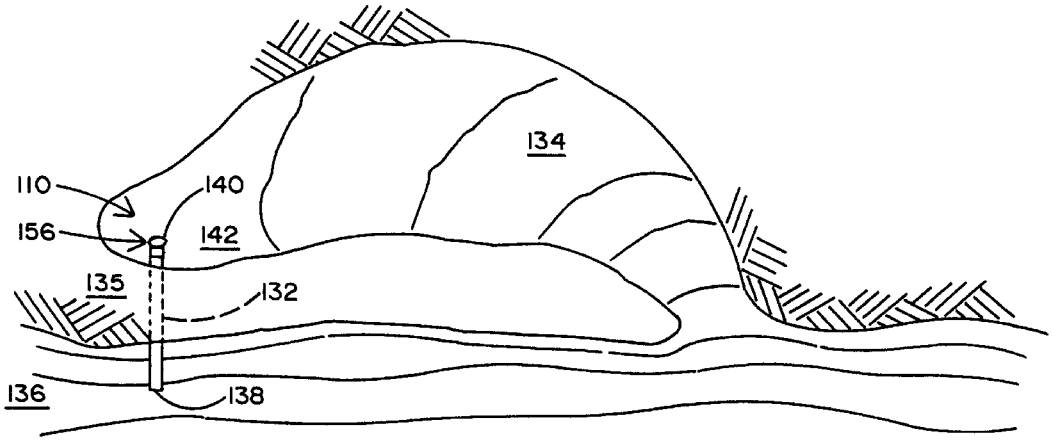
FIG. 3 is a top plan view of a second embodiment of the present invention showing a conduit partially embedded in a strip of land separating the harbor from an open sea area.
Figure 4:
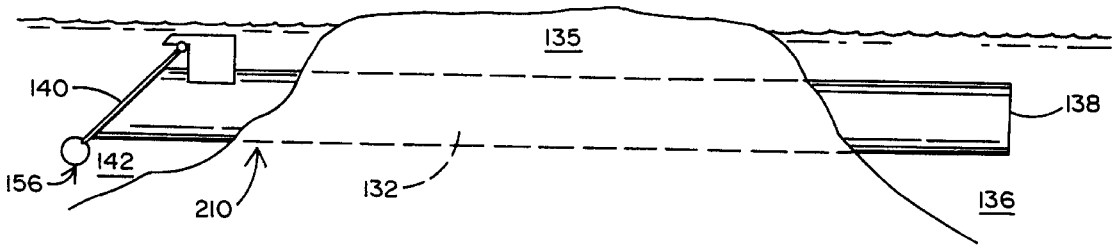
FIG. 4 is a longitudinal sectional view of the second embodiment illustrated in FIG. 3 showing the positioning of the conduit in relation to the water levels of the inner harbor area and the open sea area.

FIGS. 3 and 4 depict a second embodiment 110 of the invention having a conduit 132 with an inlet 138 placed in an open sea area 136 and an outlet 140 placed in an inner harbor area 142. Conduit 132 is placed across a narrow strip of land 135 which separates the inner harbor area 142 from the open sea area 136. Conduit 132 is preferably closed in circumference and open at both ends; examples of general forms are water pipes, storm drains, or culverts. Inlet 138 and outlet 140 are preferably submerged below low tide water levels to provide water flow therethrough under differential tidal water pressures. The conduit 132 is also preferably entirely below the low tide water levels or at least high tide water levels so that it is completely filled with water when water flow therethrough is desired. In addition, the inlet 138 is preferably submerged at a depth sufficient to avoid adverse effects of waves or surface currents caused by storms, weather conditions, etc. In all other respects, the structure and function of embodiment 110 are identical to those of embodiment 10 which have been described hereinabove so they will not be repeated.

Embodiment 110 preferably also has a one way valve or second lid mechanism 156 at outlet 140 to control water flow through conduit 132. Outlet 140 is preferably slanted to minimize lid rotation needed to fully open outlet 140. Lid mechanism 156 will be described in detail hereinbelow.

Figure 5:
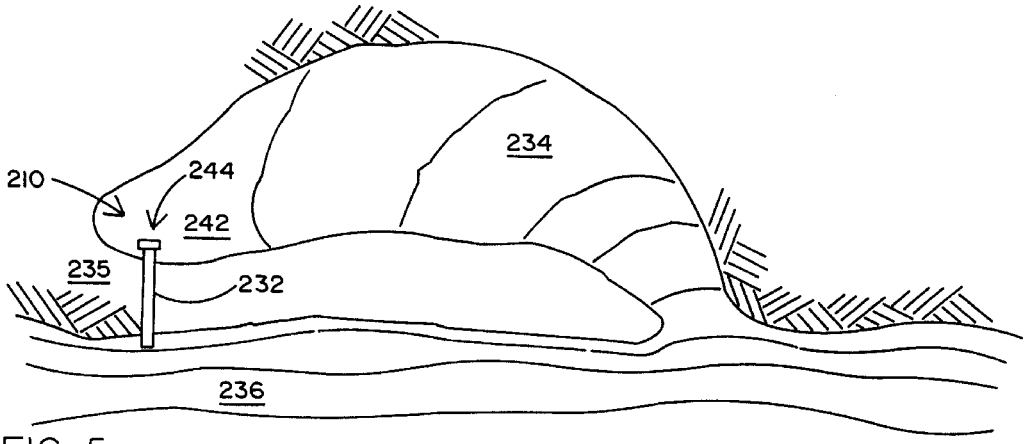
FIG. 5 is a top plan view of a third embodiment of the present invention showing a canal laid across a strip of land separating the harbor from an open sea area.
Figure 6:
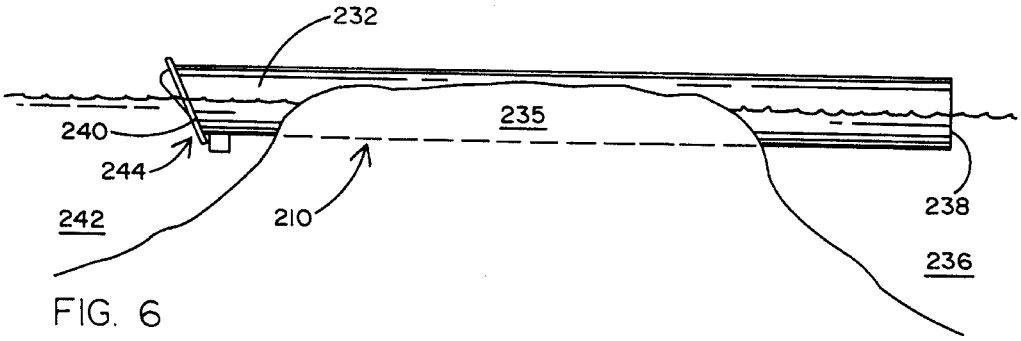
FIG. 6 is a longitudinal sectional view of the third embodiment illustrated in FIG. 5 showing the positioning of the channel in relation to the water levels of the inner harbor area and the open sea area.

FIGS. 5 and 6 depict a third embodiment 210 of the invention. Embodiment 210 includes a channel 232 which is open at the top. Channel 232 is positioned in a strip of land 235. Channel 232 is provided with an inlet 238 placed in the open sea area. 236 and an outlet 240 placed in the inner harbor area 242 so that channel 232 connects the open sea area 236 with the inner harbor area 242. Inlet 238, channel 232, and outlet 240 are preferably positioned at or below low tide water levels. However, in contrast to the first and second embodiments, water does not flow in trench 232 solely due to a water pressure differential. Instead, water generally flows through trench 232 due to the forces of gravity acting on the difference in water levels between the open sea area 236 and the inner harbor area 242. Consequently, tidal water forces produced by the incoming tides will cause water to flow from the open sea area 236 through the channel 232 and into the inner harbor area 240. In all other respects, the structure and function of embodiment 210 are comparable to those of embodiments 10 and 110 which have been described hereinabove so they will not be repeated.

Embodiment 210 is preferably provided with a one way valve or a lid mechanism 244 at outlet 240 to control water flow through channel 232. Outlet 240 is preferably slanted to minimize lid rotation needed to fully open outlet 240. Lid mechanism 244 will be described in detail hereinbelow.

Figure 7B:
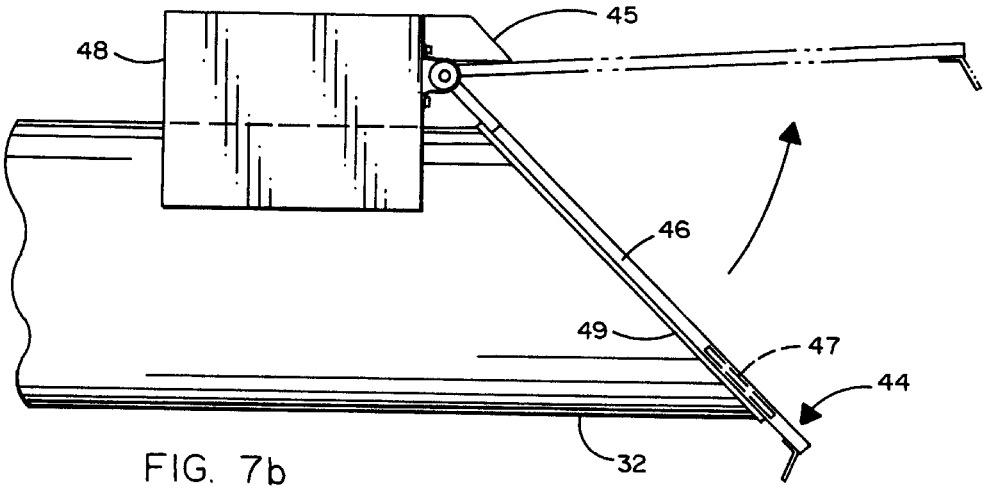
FIG. 7*b* is a side plan view of the first lid mechanism shown in FIG. 7*a*.

FIGS. 7*a* and 7*b* depicts in detail the first lid mechanism 44. Lid mechanism 44 has a lid 46 with a base 48, a pair of hinge members 50 and a hinge pin 52 rotatably connected to the base 48 preferably secured to the conduit 32. A tab 54 is secured to the lid 46 so that water flowing in a reverse direction (i.e., into the outlet 40 through the conduit 32 and out of the inlet 38) pushes the lid 46 (and outlet 40) into a closed position and also acts as a trim tab to hold the lid 46 in a fully open position when water flows through the conduit 32 into the inner harbor area 42.

The lid 46 is preferably composed of a neutrally buoyant material or has a chamber 47 therein (or attached thereto) that is filled with air in order to give the lid a desired neutral buoyancy to reduce the degree of force needed to open and close the lid. Consequently, the lid 46 can be pushed open more easily under the tidal differential water pressure exerted thereon, and, conversely, it may also be pushed closed more easily by reverse water flow acting on the tab 54. Thus, water pressure and water flow acting on components of the lid mechanism 44 open and close the lid 46 so as to control water flow through the conduit 32 in synchronization with the tidal cycle. Lid 46 (or outlet 40) is preferably provided with a seal 49 which may be composed of rubber or a soft metal such as copper or aluminum or any other suitable sealing material or compound to enable seal 49 to prevent leakage of water between the lid 46 and conduit 32. Although described and depicted in conjunction with embodiment 10, lid mechanism 44 may be incorporate in the second embodiment 110 and third embodiment 210 as well.

Although the lid mechanism 44 is shown as connected to the outlet 40 of the conduit 32, it may also be connected to the inlet 40 of the conduit 38 of the conduit 32 or to any suitable part of the conduit 32. In addition, there may also be a foundation (not shown) mounted in the bottom of the inner harbor area and secured to the base 48 to more firmly secure the lid mechanism 44 and outlet 40.

Figure 8B:
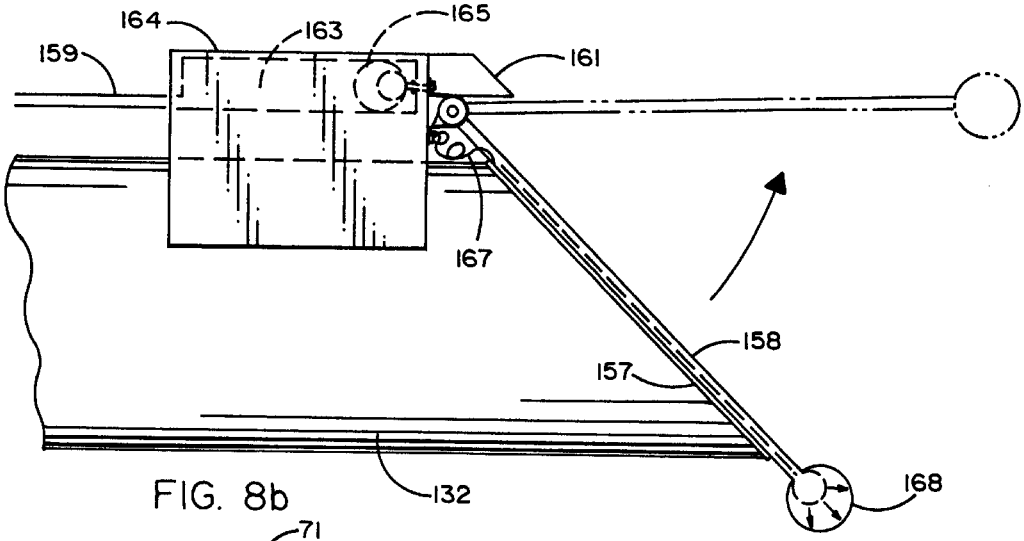
FIG. 8*b* is a side plan view of the second lid mechanism shown in FIG. 8*a*.

FIGS. 8*a* and 8*b* show in detail the second lid mechanism 156. Lid mechanism 156 has a self contained buoyancy system which includes a chamber 163 in the base 164, an inflatable bag 165 in the chamber 163 and a lower inflatable bag 168 mounted on the lid 158. Chamber 163 is sealed except for a water line 159 connecting the chamber 163 to the open sea area 136. Thus, an increase in water pressure in the open sea area 136 due to rising tide is transmitted to the chamber 164 deflating the bag 165 and forcing the air therein into line 167 and into lower bag 168 thereby inflating bag 168. Inflation of bag 168 increases the buoyancy of lid 158 causing lid 158 to open allowing water from the open sea area 136 to flow out of the conduit 132 and outlet 140 and into the inner harbor area 142. Conversely, when the water pressure in the inner harbor area 142 is greater than the water pressure in the open sea area 136 due to tidal ebb in the open sea area 136, bag 168 is deflated and air therein is forced into line 167 and into bag 165. This reduces the buoyancy of the lid 158 causing the lid 158 (and Outlet 140) to close thereby preventing water flow out of the inner harbor area 142 and into the open sea area 136 via conduit 132. Thus, differential water pressures automatically actuate lid mechanism 156 to control water flow through conduit 132. Lid 158 (or outlet 140) is preferably provided with a seal 157 which may be composed of rubber or a soft metal such as copper or aluminum or any other suitable sealing material to enable seal 157 to prevent leakage of water between the lid 158 and conduit 132.

Figure 9B:
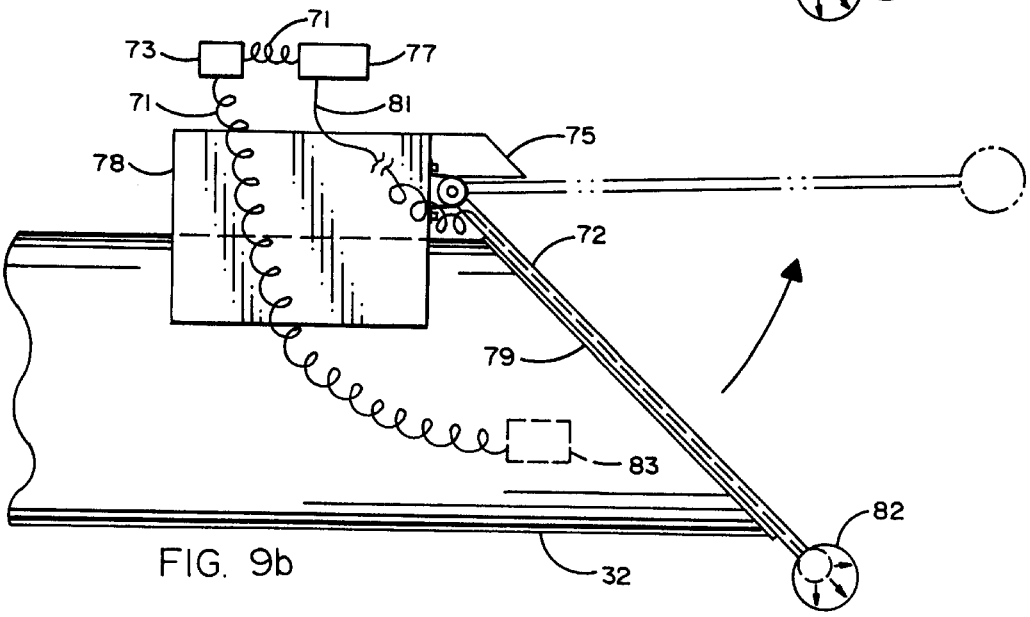
FIG. 9*b* is a side plan view of the third lid mechanism shown in FIG. 9*a*.

FIGS. 9*a* and 9*b* depict a third lid mechanism 70 having a lid 72, hinge members 74 and hinge pin 76. Pin 76 is rotatably connected to base 78 preferably by means of bearings 80. The base 78 is preferably connected to the conduit 32 or other suitable foundational structure in the harbor 34. Lid mechanism 70 is also preferably provided with an inflatable bag 82 at the lower portion of the lid 72. A suitable line 81 connects the bag 82 to a compressor 77 preferably located above the water and preferably on suitable firm foundational structure (not shown) in the harbor 34. Control unit 73 is communicatingly connecting a sensor 83 to the compressor 77 via, for example, wires 71. Thus, the compressor 77 inflates bag 82 via line 81 which makes the lid 72 positively buoyant resulting in the lid rising to thereby open the outlet 40. Lid 72 (or outlet 40) is preferably provided with a seal 79 which may be composed of rubber or a soft metal such as copper or aluminum or any other suitable sealing material to enable seal 79 to prevent leakage of water between the lid 72 and conduit 32.

Lid mechanism 70 is also provided with a sensor 83 to monitor tidal water. pressure changes and a control unit 73 to control the compressor 77 in response to sensor output. Sensor 83 is preferably mounted in the conduit 32 preferably proximal the outlet 40. Optionally, sensor 73 may be positioned proximal the inlet 38 or at any suitable location in the open sea area or in the inner harbor area. Sensor 83 may also be a plurality of sensors located at suitable locations to measure the pressure differentials of the tidal water cycles.

Sensor 83 monitors the pressure of the water in the conduit 32 due to tidal flow and ebb. Sensor 83 responds to an increase in water pressure in the conduit 32 produced by the incoming tide and transmits a corresponding signal to control unit 73. In response, control unit 73 transmits an electrical current to compressor 77 to pump air into lower air bag 82 via line 81 thereby giving lid 72 a positive buoyancy and opening the same. Thus, water is allowed to flow from the open sea area 36 into the inner harbor area 42 via conduit 32. When the tide is outgoing and the sensor 83 senses that the water pressure in the conduit 32 is no longer increasing (or when it senses the water pressure therein is decreasing), it transmits a corresponding signal to control unit 73 which, in response, transmits an electrical current to compressor 77 to reduce the air pressure in the line 81 (and bag 82) to thereby decrease the buoyancy of the lid 72 and close the same. Consequently, the water in the inner harbor area 42 will flow through the bay 43 and into the open sea area 36 thereby removing stagnant water and harbor contaminants from the harbor 34.

Figure 10A:
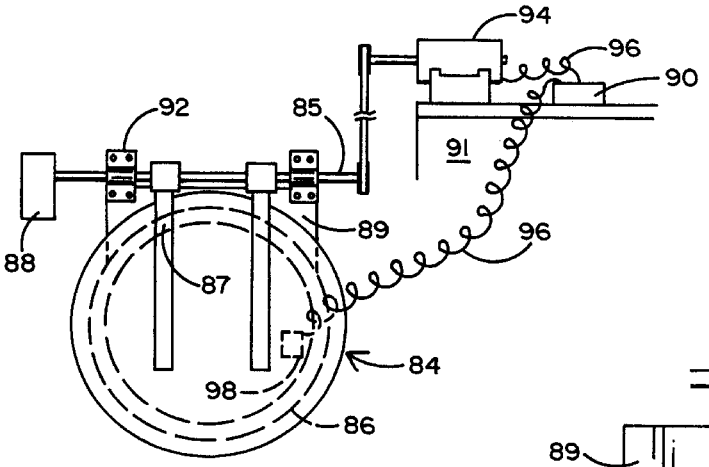
FIG. 10*a* is a front plan view of a fourth lid mechanism connected to the conduit of the second embodiment for preventing reverse flow of water through the conduit and having a motor for actuating the lid.
Figure 10B:
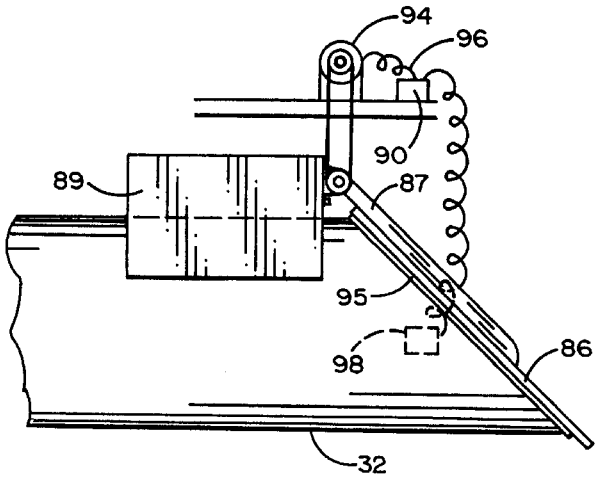
FIG. 10*b* is a side plan view of the fourth lid mechanism shown in FIG. 10*a*.

FIGS. 10*a* and 10*b* illustrate a fourth type of lid mechanism 84. Lid mechanism 84 includes a lid 86, a hinge pin 85 rotatably connected to a base 89 by means of bearings 92, and hinge members 87 interconnecting the lid 86 and the hinge pin 85. The base 89 is preferably secured to the conduit 32 although it may also additionally be secured to a foundational structure (not shown) in the harbor 34. Counterweights 88 secured to pin 85 are also provided to reduce the amount of force required to open and close the lid 86. However, counterweights 88 may also be omitted from the lid mechanism 84 in favor of a neutrally buoyant lid, if desired. A motor 94 (preferably electric) is also provided and operatively connected (by means of suitable gears) to the lid mechanism 84, as shown. Motor 94 is also preferably mounted on foundational structure 91 in the harbor 34. A sensor 98 is communicatingly connected to a control unit 90 (or to motor 94) by wires 96. Sensor 98 is preferably mounted in the conduit 32 preferably proximal the outlet 40. Optionally, sensor 98 may be positioned proximal the inlet 38 or at any suitable location in the open sea area 36 or in the inner harbor area 42. In addition, sensor 98 may also be a plurality of sensors located at suitable locations to measure the pressure differentials of the tidal cycles.

Sensor 98 monitors the pressure in the water in the conduit 32 due to tidal flow and ebb. Sensor 98 responds to an increase in water pressure in the conduit 32 produced by the incoming tide and transmits a corresponding signal to control unit 90. In response, control unit 90 transmits an electrical current to motor 94 to actuate the lid mechanism 84 and thereby open the lid 86. Thus, water is allowed to flow from the open sea area 36 through the conduit 32 into the inner harbor area 42. When the tide is outgoing and the sensor 98 senses that the water pressure in the conduit 32 is no longer increasing (or when it senses the water pressure therein is decreasing), it transmits a corresponding signal to control unit 90 which, in response, transmits an electrical current to motor 94 to close lid 86 by actuation of lid mechanism 84. Consequently, the water in the inner harbor area 42 will flow through the bay and into the open sea area thereby removing stagnant water and harbor contaminants from the harbor 34.

Selection of the amount of weight provided on the counterweights 88 and/or the distance of the counterweights from the pin 85 (or from the axis of the lid mechanism 84) allows selection of the degree of force required to open or close the lid 86. Alternatively, the counterweights 88 may instead be chambers (or bags) filled with air and positioned to give the lid 86 a neutral buoyancy thereby reducing the degree of force required to open and/or close the lid 86 and outlet 40. Counterweights 88 may also be provided on other lid mechanisms described hereinabove to allow the direction and degree of force of water flow against the lids to automatically open and/or close the conduit 32 and thereby allow water flow therethrough from the open sea area into the inner harbor area 42 and prevent water flow therethrough from the inner harbor area 42 into the open sea area 36. Lid 86 (or outlet 40) is preferably provided with a seal 95 which may be composed of rubber or a soft metal such as copper or aluminum or any other suitable sealing material to enable seal 95 to prevent leakage of water between the lid 86 and conduit 32.

The upper portions of the hinge members 87, hinge pin 85, the upper portion of the base 89 and the counterweight 88 are preferably above the high tide water level of the inner harbor area 42 (or alternatively above the low tide water level of the inner harbor area 42). Since these corrosion sensitive parts of lid mechanism 84 are out of the water, they are not as susceptible to corrosion (and binding due to contamination of the moving parts) as lid mechanisms 44, 156 and 70 which are generally submerged in the inner harbor area 42 waters. Consequently, placing these components out of the water extends the operational life and trouble free performance of lid mechanism 84 (and conduit 32).

Figure 11B:
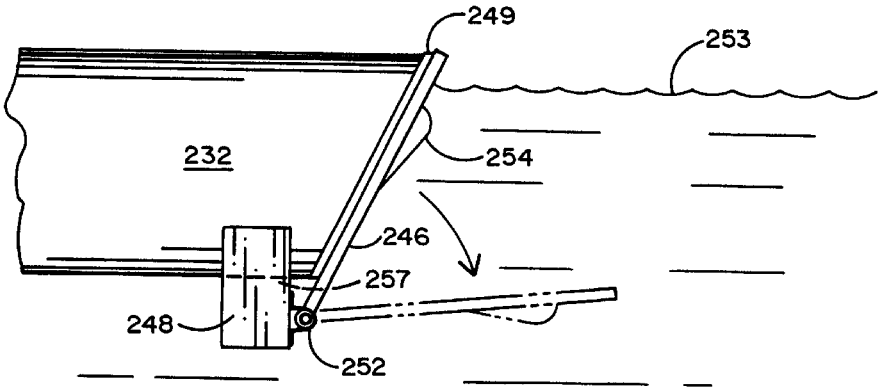
FIG. 11*b* is a side plan view of the fourth lid mechanism shown in FIG. 11*a*.
Figure 11A:
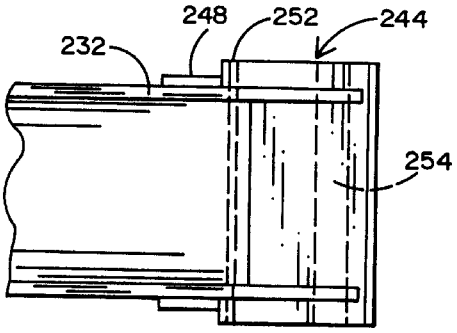
FIG. 11*a* is a top plan view of a fifth lid mechanism connected to the channel of the third embodiment for preventing reverse flow of water through the channel.

FIG. 11*a* and 11*b* illustrate a fifth lid mechanism 244 adapted for use with the channel 232. Lid mechanism 244 (or another suitable type of one way valve) prevents reverse flow of water through channel 232 in order to preclude water from flowing out of the inner harbor area 242 through channel 232 and into the open sea area 236. Lid mechanism 244 preferably includes a lid 246 secured to a hinge pin 252 which is rotatably mounted on a base 248. The base 248 is preferably mounted on channel 232 or an a foundational structure (not shown) on the strip of land 235 or in the harbor 234. Lid 246 is hinged at the bottom and is preferably provided with a seal 249 which may be composed of rubber or a soft metal such as copper or aluminum or any other suitable sealing compound to enable seal 249 to prevent leakage of water between the lid 246 and channel 232.

Lid mechanism 244 is also provided with a flotation bag or chamber 254. Flotation bag 254 is preferably mounted on an outer surface of the lid 246 and preferably filled with air. Bag 254 is sufficiently large to give lid 246 (together with bag 254) a neutral buoyancy when at a high tide water level 253. This neutral buoyancy permits pressure and flow sensitive opening and closing of the lid 246 and outlet 240 as with the other lid mechanisms described hereinabove when the incoming tide has filled the inner arbor area 242 to desired water levels. Thus, water in the inner harbor area 242 must flow out through the harbor bay 243. The bag 254 may optionally be inflated and deflated by an external source of air (not shown) so the inflation of the bag 254 will result in opening of outlet 240 in order to provide more control over the opening and closing of the lid 246 and outlet 240.

The seat on outlet 240 is slanted over the lid 246 to allow the positively buoyant lid 246, acting under its buoyancy force, to seat firmly against the seal 249 when closed. Similarly, when the buoyancy is reversed, the lid will swing open quickly to allow maximum flow of water.

When the inner harbor area 242 is at low tide water levels and the incoming tide causes water to flow in the channel 232, the flotation bag 254 will be above water resulting in the weight of the lid (or the force of the water flow against the lid 246) causing the lid 246 and outlet 240 to open. Thus, operation of lid mechanism 244 is actuated by differential pressure and effectively allows water flow from the open sea area 236 into the inner harbor area 242 via channel 232 while preventing water flow from the inner harbor area 242 into the open sea area 236 via channel 232. In addition, when the lid 246 is in its open position, the positioning of the hinge pin 252 below the channel 232 provides an open area 257 forming a venturi to enhance water flow through the channel 232. In addition, conduits 32, 132 and 232 may be utilized to provide water flow therethrough (in a reverse direction) from the inner harbor area 42 into the open sea area 36. This may be effectuated by positioning a one way valve or any suitable choice from among lid mechanisms 44, 156,70,84 or 244 at the inlet 3, 138 or 238. Thus, when the water level in ihe inner harbor area 42 is higher that the water level in the open sea area 36 contaminated water will flow from the inner harbor area 42 into the open sea area 36 via conduit 32, 132 or 232. This may be particularly desirable in those harbors in which sewage (or other pollutants) is emptied into the inner harbor area 42 by a contaminated river, sewage treatment plant or other means.

Thus, there has been provided, in accordance with the invention, a system and method for cleansing a harbor which is economical to construct and use. It is to be understood that all the terms used herein are descriptive rather than limiting. Although the invention has been described in conjunction with the specific embodiments set forth above, many alternative embodiments, modifications and variations will be apparent to those skilled in the art in light of the disclosure set forth herein. Accordingly, it is intended to include all such alternative embodiments, modifications and variations that fall within the spirit and scope of the invention as set forth in the claims hereinbelow.

I claim:

1. A method for cleansing a polluted harbor utilizing the cyclic surface elevation wave of ocean tides when propagating along a path from a clean ocean, through a substantially unrestricted harbor entrance, and thence through a harbor channel to a polluted harbor area; the method including the steps of:

selecting a first area and a second area located along the path, the areas having sufficient relative separation to form a hydrostatic pressure differential, the areas containing relatively clean water and polluted water respectively; and establishing fluid communication between the areas, the fluid communication responsive to the hydrostatic pressure differential in producing fluid flow between the areas.

2. A method for cleansing a polluted harbor according to claim 1 and additionally obtaining flow resulting in a general water circulation cleansing the harbor, with the additional step of:

converting the cyclic elevation difference in the tide wave into one-way fluid flow.

3. A method for cleansing a polluted harbor according to claim 2 wherein the first area, located substantially in the ocean, and the second area, located in the harbor, is separated by an isthmus, adding the step of:

establishing fluid communication across the isthmus.

4. In a harbor subject to cyclic ocean tides, where the tides propagate as a surface elevation wave along a path from an open ocean area, through a substantially unobstructed harbor entrance area, and thence through a harbor channel to a polluted harbor area, where the surface elevation wave produces a useful head between areas along the path of propagation, and where the head enables fluid communication, a system for establishing fluid flow of clean ocean water to cleanse the polluted harbor area comprising:

a fluid communication conduit with ends having first and second openings;

the first opening located in the open ocean area; and the second opening located in the polluted harbor area.

5. A system according to claim 4 wherein at least one of the openings is submerged.

6. A system according to claim 4 wherein the first opening is submerged.

7. A system according to claim 4 wherein the second opening is submerged.

8. A system according to claim 4 achieving flow management by further including:

flow control means in at least one of the openings for regulating flow of water.

9. A system according to claim 8 achieving general circulation of water between the open ocean area and the polluted harbor area, wherein the flow control means comprises:

a one-way valve.

10. A system according to claim 9 wherein the one way valve includes:

a pressure actuated check-valve.

11. A system according to claim 10 wherein the pressure actuated check valve comprises:

a valve seat mounted on the conduit in at least one of the openings; and a lid rotatably connected to the at least one of the openings and positioned to close and open against the valve seat.

12. A system according to claim 8, the system responsive to the tidal propagation, wherein the flow control means additionally includes:

tide head sensing means.

13. In a polluted bay which is open to an ocean area through a substantially unobstructed entrance, the bay having back areas separated from the ocean area by an isthmus, a system for cleansing the polluted bay comprising:

fluid communication means across the isthmus for establishing flow of water between the open ocean area and a back area; and flow control means in the fluid communication means for regulating flow of water.

14. A system according to claim 13 wherein the connecting means is an open trench.

15. A check-valve, for controlling fluid flow in a conduit, having a seat member aligned with the conduit and a gate member rotatable coupled to the seat member, wherein kinetic energy of water flowing against the gate member maintains it in a generally open position, whereas water flowing in an opposite direction produces swirls around the gate member, the swirls creating a force thereon causing the gate member to close, and further:

wherein the swirls are enhanced by trim tabs.

* * * * *